US006402095B1

(12) United States Patent
Achleitner et al.

(10) Patent No.: US 6,402,095 B1
(45) Date of Patent: Jun. 11, 2002

(54) DEVICE FOR DISPLACING THE MOVEABLE PARTS OF RAIL SWITCHES OR CROSSINGS

(75) Inventors: Herbert Achleitner, Graz; Josef Hörtler, Knittelfeld, both of (AT)

(73) Assignee: VAE Aktiengesellschaft, Vienna (AT)

( * ) Notice: Subject to any disclaimer, the term of this patent is extended or adjusted under 35 U.S.C. 154(b) by 0 days.

(21) Appl. No.: 09/647,877

(22) PCT Filed: Mar. 31, 1999

(86) PCT No.: PCT/AT99/00087

§ 371 (c)(1),
(2), (4) Date: Dec. 11, 2000

(87) PCT Pub. No.: WO99/51480

PCT Pub. Date: Oct. 14, 1999

(30) Foreign Application Priority Data

Apr. 7, 1998 (AT) ..... 603/98

(51) Int. Cl.[7] ..... B61L 5/00
(52) U.S. Cl. ..... 246/257
(58) Field of Search ..... 246/93, 100, 116, 246/139, 257, 258, 271, 361

(56) References Cited

U.S. PATENT DOCUMENTS

| | | | | | |
|---|---|---|---|---|---|
| 5,417,392 | A | * | 5/1995 | Wyatt | 246/257 |
| 5,687,935 | A | * | 11/1997 | Durchschlag et al. | 246/257 |
| 5,772,157 | A | * | 6/1998 | Lauck et al. | 246/257 |
| 6,056,244 | A | * | 5/2000 | Durchschlag et al. | 246/257 |

FOREIGN PATENT DOCUMENTS

| | | |
|---|---|---|
| DE | 2 144 564 | 3/1973 |
| DE | 44 20 459 | 1/1995 |
| EP | 0 778 191 | 6/1997 |
| WO | WO 96/34786 | 11/1996 |

* cited by examiner

*Primary Examiner*—Mark Le
(74) *Attorney, Agent, or Firm*—Kevin E. Joyce

(57) ABSTRACT

In a device for displacing the movable parts of rail switches or crossings, in which a plurality of hydraulic cylinder piston units engaging in an offset manner in the longitudinal direction of the rails are each connected in series, at least one directional or seat valve (9) capable of being adjusted in a pressure controlled manner is inserted in the duct (8) that connects the hydraulic cylinder piston units (1 to 4) arranged in series, which directional or seat valve blocks the connection to the consecutive cylinder piston unit if a preset differential pressure is exceeded.

6 Claims, 2 Drawing Sheets

$$p_1 \cdot A = p_2 \cdot A + F_W$$

$$(p_1 - p_2) \cdot A = F_W$$

$$\Delta p \cdot A = F_W$$

DEVICE FOR DISPLACING THE MOVEABLE PARTS OF RAIL SWITCHES OR CROSSINGS

This application is the national phase of international application PCT/AT99/00087 filed Mar. 31, 1999 which designated the U.S.

BACKGROUND OF THE INVENTION

1. Field of the Invention

The invention relates to a device for displacing the movable parts of rail switches or crossings, in which a plurality of hydraulic cylinder piston units engaging in an offset manner in the longitudinal direction of the rails are each connected in series, wherein at least one directional or seat valve capable of being adjusted in a pressure controlled manner is inserted in the duct that connects the hydraulic cylinder piston units arranged in series.

2. Prior Art

A device of the initially defined kind may already be taken, for instance, from WO 96/34786. In that known device for setting switches, a plurality of cylinder piston units are provided, which may be connected in parallel or in series. In the event that such cylinder piston units are connected in series, push-open valves are described in WO 96/34786, which ensure that, after a hydraulic cylinder piston unit has been shifted completely, the hydraulic pressure required for displacement is transmitted directly into the respective working volumes of consecutive hydraulic cylinder piston units. During shifting, the actuation of consecutively arranged hydraulic cylinder piston units usually is effected by means of the pressure of the fluid volume displaced out of a preceding hydraulic cylinder piston unit.

During the displacement of movable parts of rail switches or crossings, the pressure applied at first is effective in one of the working volumes of the respective actuating cylinder, multiplicaton of that pressure by the respectively active piston surface resulting in the actuating force. Said actuating force is counteracted by displacement resistances, such resistances being likely to cause a rapid increase in pressure, in particular at a blockage of the displacement movement. In order to secure the overall hydraulic system, it is therefore known to centrally provide pressure control valves, such a configuration being described, for instance, in DE 21 44 564 A1. Inadmissible operating conditions, however, will only insufficiently be detected by means of such a pressure control valve, since pressure control valves of that type have to be designed for a working pressure that is higher than the sum of the displacement resistances or resistance forces of the hydraulic cylinder piston units connected in series.

In the device that has become known from EP 778 191 A2, safety means are provided, which, as the displacement movement is being interrupted, render the individual cylinder piston units pressureless to such an extent that thermal expansions may be taken into account. Such a configuration does not provide any automatic cutoff in the event that inadmissible operating conditions of individual cylinder piston units are exceeded.

SUMMARY OF THE INVENTION

The invention aims to further develop a device of the initially defined kind, comprising hydraulic cylinder piston units connected in series, to the extent that any inadmissible operating conditions will be recognized early and in time and any further displacement of the switch actuator will be stopped if the admissible resistance force acting on a hydraulic cylinder piston unit is exceeded. To solve this object, the configuration according to the invention essentially is characterized in that, if a preset difference of the pressures prevailing in oppositely arranged working volumes of the same, preceding cylinder piston unit is exceeded, the directional or seat valve blocks the connection to the consecutive cylinder piston unit. Due to the fact that the directional or seat valve capable of being adjusted in a pressure controlled manner, which is inserted in the duct that interconnects the hydraulic cylinder piston units arranged in series, blocks if a preset difference of the pressures prevailing in oppositely arranged working volumes of the same, preceding cylinder piston unit is exceeded, any inadmissible rise in the differential pressure as occurs on account of an elevated displacement resistance will be recognized in time and, due to the fact that in those cases the connection to the consecutive cylinder piston unit is blocked immediately, any further displacement movement of switch will be reliably stopped such that inadmissible deformations can be excluded.

Advantageously, the configuration is devised such that a directional or seat valve capable of being adjusted in a pressure controlled manner is each inserted in the supply duct and in the discharge duct of at least one hydraulic cylinder piston unit, the displacement actuator of which directional or seat valve is powered by the pressure prevailing in different working volumes of the same cylinder piston unit, wherein, in particular, the circuitry in a particularly advantageous manner is realized such that the valves of the individual cylinder piston units are each controlled in a manner that the valve opening into a working volume is powered by the pressure prevailing in the oppositely arranged working volume of the same cylinder piston unit. In order to displace a movable part of a rail switch or crossing, a working pressure $p_1$ aimed to shift the piston in the sense of the displacement movement enters into effect in one hydraulic cylinder piston unit each. Said working pressure $p_1$ which, multiplied by the respectively active cross sectional area A of the piston, defines the actuating force F is counteracted by the force of the shift resistance $F_W$. From the working volume arranged opposite the working volume that is powered by the pressure $p_1$, fluid under a pressure $p_2$ that corresponds to the reduction caused by the force corresponding to the external resistance is pressed out into the working volume of a consecutive cylinder piston unit for a displacement movement in the same direction, that pressure difference not constituting any problem as long as the displacement resistance occurring remains within defined limits. In detail, the following relations apply:

$$p_1 \cdot A = p_2 \cdot A + F_W$$

$$(p_1 - p_2)\, A = F_W$$

$$\Delta p \cdot A = F_W$$

wherein, in the above equations, $p_1$ represents the working pressure prevailing in the respective cylinder piston unit concerned and $p_2$ refers to the pressure of the fluid displaced out of the oppositely arranged working volume of the same cylinder piston unit. The pressure difference occurring is proportional to the shift resistance, wherein, due to the fact that this pressure difference is then used for controlling the respective valve, transmission to the consecutive hydraulic cylinder piston unit will be blocked if this pressure difference exceeds a predetermined value. The directional or seat valves powered by the respective pressure difference in that case may be united to a structural unit directly with one hydraulic cylinder piston unit each and are able to respond to inadmissible operating conditions as may occur in connection with an individual one of a plurality of hydraulic cylinder piston units connected in series.

The respectively last one of a plurality of hydraulic cylinder piston units arranged in series may be so designed as to not include any additional valves, wherein the configuration in a particularly simple manner is devised such that the hydraulic cylinder piston unit arranged last in the series connection is connected directly with the valves of preceding cylinder piston units.

In the main, the configuration according to the invention always causes the downstream valve to be closed as the pressure difference occurring has reached the admissible extent defined by the resistances under normal operation. In order to minimize the specific resistances in a plurality of such hydraulic cylinder piston units connected in series, it is advantageous to reduce the lengths of the respective return ducts. To this end, the configuration advantageously is devised such that the series connection in the event of more than three hydraulic cylinder piston units connected in series is realized in a manner that the working volume of a hydraulic cylinder piston unit is connected with the working volume of a hydraulic cylinder piston unit after next, with the valves being arranged therebetween. In this manner, the lengths of the return ducts can each be minimized so as to ensure precise responding.

BRIEF DESCRIPTION OF THE DRAWINGS

In the following, the invention will be explained in more detail by way of an exemplary embodiment schematically illustrated in the drawing. Therein.

DETAILED DESCRIPTION OF A PREFERRED EMBODIMENT OF THE INVENTION

Figure 1:
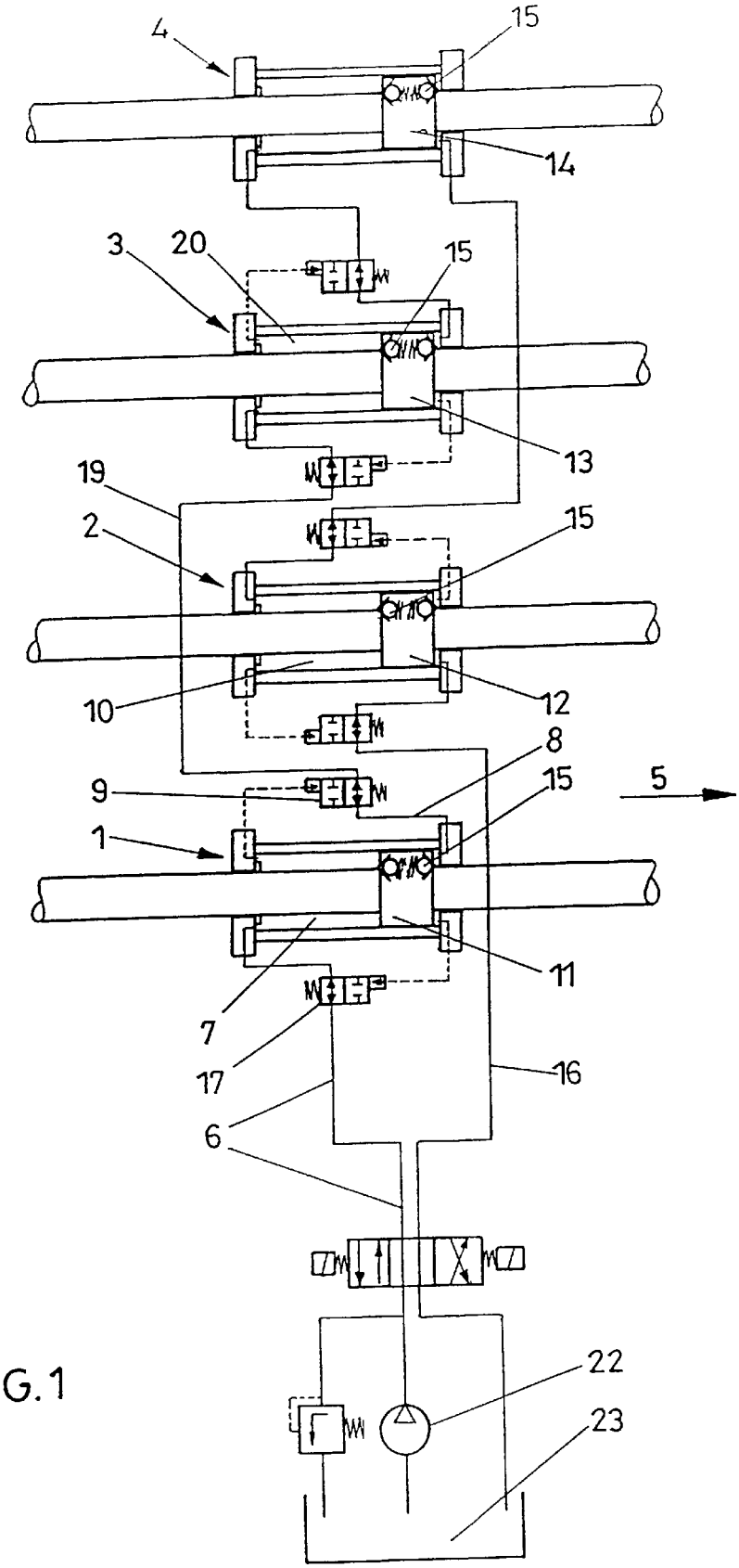
FIG. 1 is a schematic representation of a plurality of hydraulic cylinder piston units arranged in series for displacing rail switches.

FIG. 1 illustrates hydraulic cylinder piston units 1 to 4, which are arranged so as to be distributed in the longitudinal direction of the rails over the length of the rail switch to be displaced. Fluid is pressed into the first working volume 7 of the first hydraulic cylinder piston unit 1 via a duct 6 in order to displace a switch tongue in the sense of arrow 5, the fluid emerging from the oppositely arranged working volume getting into the working volume 20 of the consecutively arranged hydraulic cylinder piston unit 3 via a duct 8, with a pressure difference controlled valve 9 being arranged therebetween.

The pistons 11, 12, 13 and 14 of the hydraulic cylinder piston units arranged in series each comprise push-open valves 15 which, at the end of the admissible displacement path, cause the preceding working volume to be opened for pressure transmission to the succeeding working volume of a further hydraulic cylinder piston unit.

The fluid displaced out of the respectively opposite working volumes gets into the return duct 16 with the respective valves actuatable as a function of the pressure difference being each arranged therebetween, wherein the pump 22 or a pressure reservoir is connected to the flow duct 6 and the duct leading to the tank 23 is connected to the return duct 16. For actuation in a direction of displacement opposite to the sense of arrow 5, the connections are each interchanged accordingly, for instance, by means of a valve.

Figure 2:
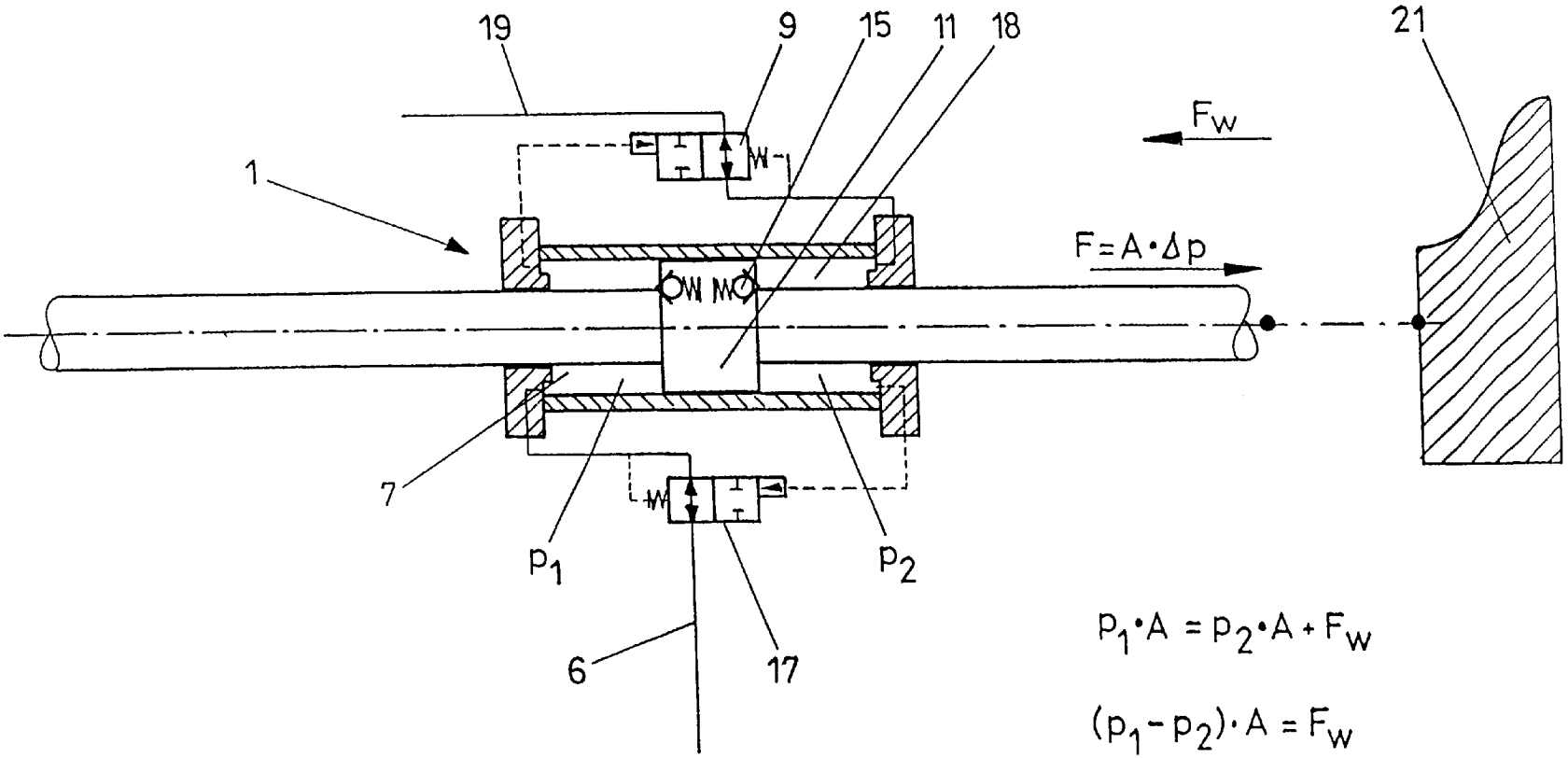
FIG. 2 depicts an enlarged detail of the hydraulic cylinder piston units used in FIG. 1 as well as of the valve control.

In the illustration depicted in FIG. 2, of a hydraulic cylinder piston unit 1 of this type on an enlarged scale, the pressure conditions are more clearly elucidated. The pressure which is to generate the actuating force is introduced into the working volume 7 of the hydraulic cylinder piston unit 1 via the pressure duct 6 and a first pressure medium controlled valve 17 and generates an actuating power by taking into account the active surface of the piston 11. From the oppositely arranged working volume 18, fluid upon interposition of the pressure difference controllable valve 9 in the duct 19 is applied to a consecutively arranged working volume which, as is apparent from FIG. 1, corresponds to the working volume 20 of the next but one hydraulic cylinder piston unit 3. Due to the displacement resistances and the counterdirected force $F_W$ thereby obtained, an accordingly reduced pressure $p_2$ is available there, which is smaller than the pressure $p_1$ prevailing in the working volume 7. The pressure difference signal each actuates the succeeding valve 9 so as to block the duct 19 if the admissible value has been exceeded. The blockage of this valve in that case is effected, for instance, in an intermediate position as illustrated in FIG. 2, in which the push-open valves 15 have not yet been actuated and, as a result, a relevant pressure difference has actually occurred between the working volumes 7 and 18.

The switch tongue to be actuated is schematically indicated by 21 in FIG. 2.

By the valve 9 being actuated as a function of the pressure difference, further displacement of the switch tongue 21 is prevented and any inadmissible operating state is recognized early and in time, thus preventing overstressing.

What is claimed is:

1. A device for displacing movable parts of a rail switch or crossing, comprising:

a plurality of hydraulic cylinder piston units arranged in offset relationship with one another in a longitudinal direction of a rail for engaging said parts, said units being hydraulically connected in series; and at least one pressure controlled directional valve connected to a duct which joins a series-connected pair of said units, said valve blocking hydraulic flow between the said series-connected pair of units if a preset differential pressure is exceeded, said differential pressure being the difference between pressure levels prevailing in oppositely arranged working volumes of one unit of the series-connected pair of units.

2. A device according to claim 1, comprising a plurality of said pressure controlled directional valve;, one of said pressure controlled directional valves being connected to a duct which supplies at least one of the hydraulic cylinder piston units, and an additional one of the said pressure controlled directional valves being connected to a discharge duct of said at least one hydraulic cylinder piston unit, each of said pressure controlled directional valves being powered by pressure levels prevailing in different working volumes of the hydraulic cylinder piston unit with which the respective pressure controlled directional valves are connected.

3. A device according to claim 1, wherein an individual pressure controlled directional valve connected to one working volume of a hydraulic cylinder piston unit is powered by the pressure level prevailing in an oppositely arranged working volume of the same unit.

4. A device according to any one of claims 1 to 3, wherein one of said series-connected hydraulic cylinder piston units is connected directly with a pressure controlled directional valve associated with another unit.

5. A device according to any one of claims 1 to 3, wherein in the event more than three hydraulic cylinder piston units are connected in series, a working volume of one unit is connected to a working volume of that unit which follows the next unit of the series, at least one pressure controlled directional valve being arranged in the connection between the working volumes so connected.

6. A device according to claim 5, wherein one of said series-connected hydraulic cylinder piston units is connected directly with a pressure controlled directional valve associated with another unit.

* * * * *